United States Patent [19]

McCoy

[11] 3,945,225

[45] Mar. 23, 1976

[54] CONTINUOUS TEXTILE DYEING APPARATUS

[76] Inventor: Lyle E. McCoy, 533 N. Whitehall Road, Norristown, Pa. 19401

[22] Filed: Aug. 29, 1974

[21] Appl. No.: 501,784

Related U.S. Application Data

[62] Division of Ser. No. 363,985, May 25, 1973.

[52] U.S. Cl. ..... 68/5 D; 68/9; 68/13 R; 68/19.1; 68/20; 118/67

[51] Int. Cl.[2].. D06B 3/02; D06B 9/02; D06B 21/00

[58] Field of Search ..... 68/5 D, 5 E, 13 R, 19, 68/9, 19.1, 20; 118/61, 66, 67, 69

[56] References Cited

UNITED STATES PATENTS

| | | | |
|---|---|---|---|
| 2,269,169 | 1/1942 | Van Derhoef et al. | 118/67 X |
| 2,571,494 | 10/1951 | Spooner | 68/20 X |
| 3,665,734 | 5/1972 | Hauser et al. | 68/19.1 X |
| 3,782,995 | 1/1974 | Takimoto et al. | 118/67 X |

*Primary Examiner*—Daniel Blum
*Assistant Examiner*—Philip R. Coe

[57] ABSTRACT

The apparatus for dyeing textiles, including the dyeing of synthetic or partially synthetic textiles with disperse dyes, wherein a dye mixture is applied to the textile and subsequently maintained in a gelled but unfrozen condition during drying to prevent migration of the dye.

5 Claims, 2 Drawing Figures

CONTINUOUS TEXTILE DYEING APPARATUS

CROSS-REFERENCE TO RELATED APPLICATIONS

This application is a division of my copending patent application Ser. No. 363,985, filed May 25, 1973.

BACKGROUND OF THE INVENTION

As is well known to those versed in the dyeing arts, the dyeing of synthetic fabrics, say 100% polyester, by continuous dyeing procedures has heretofore been subject to problems, including that of migration, as when the hydrophobic materials' resist adsorption and absorption, so that the dye migrates, as due to gravity, surface tension phenomenon, or other, carrying solids and depositing unevenly to result in uneven colors when the dyestuff is fixed. While it has been attempted to avoid migration and resultant uneven dyeing by the use of thickeners in the dye stuff mixture, this has not been found satisfactory, as the amount of thickener may be quite critical and extremely hard to control to obtain desired dyestuff penetration of the fibers and wetting of the fabric. Therefore, it has, in the past, been required to batch-dye certain fabrics, such as 100% polyester in order to obtain desirable results, which substantially increases costs in labor, overhead and inventory.

SUMMARY OF THE INVENTION

It is, therefore, an important object of the present invention to provide a textile dyeing apparatus of the type described which overcomes the above-mentioned difficulties, assures uniformity of dyeing even of 100% synthetic fabrics, and enables the dyeing procedure to be continuous and rapid to effect substantial economies in production.

It is a more particular object of the present invention to provide a textile dyeing apparatus wherein a mixture of disperse dye may be applied to a synthetic textile, say 100% polyester, achieving necessary fabric wetting, and may be dried without migration for fixation with highly satisfactory color and uniformity, all at substantial savings in cost over heretofore necessary batch procedures.

Other objects of the present invention will become apparent upon reading the following specification and referring to the accompanying drawings, which form a material part of this disclosure.

The invention accordingly consists in the features of construction, and combinations and arrangements of parts, which will be exemplified in the following description, and of which the scope will be indicated by the appended claims.

DESCRIPTION OF THE PREFERRED EMBODIMENT

Figure 1:
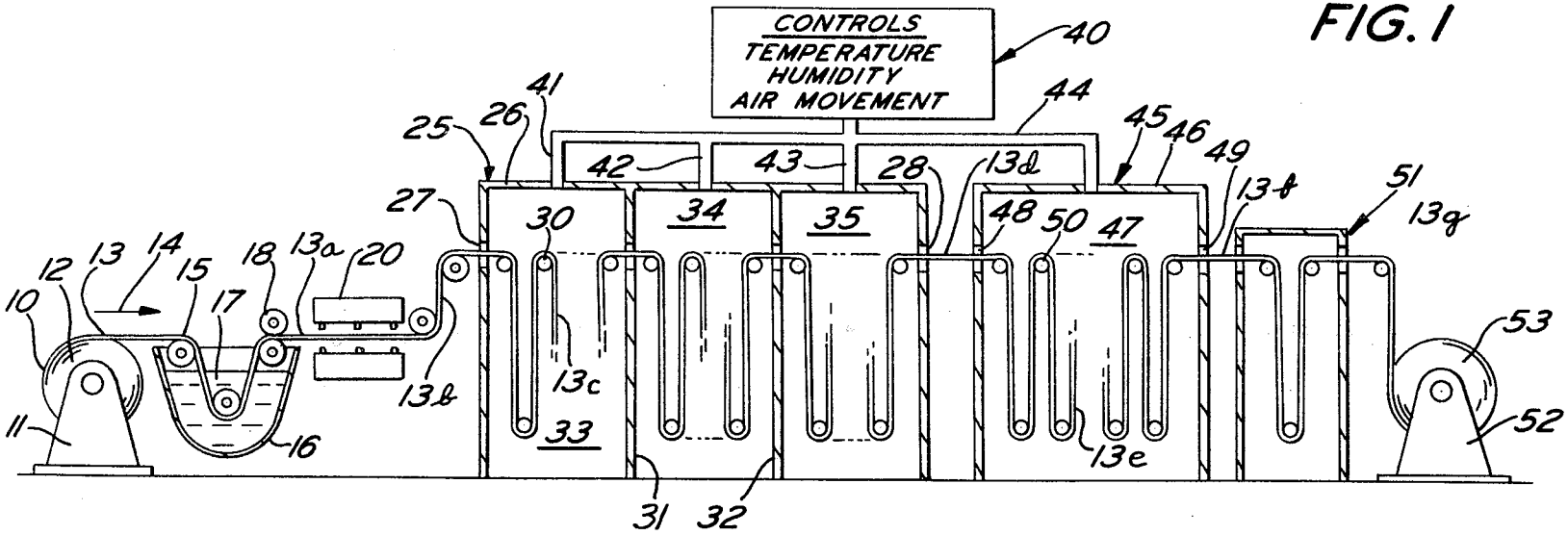
FIG. 1 is a schematic flow diagram illustrating the apparatus of the present invention.

Referring now more particularly to the drawings, and specifically to FIG. 1 thereof, the apparatus illustrated therein includes a textile supply or let-off station 10, such as a pedestal type support 11 for a coil or roll 12 of textile material 13. While the textile may be any desired fabric, such as knit or woven, natural or synthetic, the dye problems discussed hereinbefore are most severe with 100% synthetic fabric, such as polyester, and for purposes of illustration the fabric 13 may be ocnsidered as 100% polyester.

From the let-off station 10, the textile web 13 proceeds downstream, as in the direction of arrow 14, to a padding station or machine 15. The pad or padding station 15 may apply a dye stuff mixture to the textile web 13, as by immersion in a trough 16 containing the mixture 17, and subsequent squeezing between the rollers 18, to remove excess mixture. Of course, the dyestuff mixture may be applied by other suitable means, as desired.

The web, as at **13*a* passes downstream from the pad 15 to a cooling station 20, at which the continuously moving web is cooled to a desired temperature. The cooling station 20 may include cool air blowing means, chilled rollers, or other suitable cooling means controlled to maintain a desired temperature of the textile web with the dyestuff mixture 17** having been applied to the web.

Continuing downstream from the cooling station 20, the cooled web **13*b* enters a dryer or drying station generally designated 25. The dryer or drying station may include a longitudinally extending cabinet, chamber or enclosure 26 having an upstream web inlet opening 27, and a downstream web outlet opening 28. Suitable web conveyor means, such as a festoon type web conveyor 30 may be located in the cabinet 26 for conveying the textile through the cabinet. Interiorly of the cabinet may be dividers or partitions as at 31 and 32 subdividing the space within the chamber 26 into a plurality of regions or compartments 33, 34 and 35, located longitudinally along the path of web movement. While there have been shown a series of three regions or compartments 33, 34 and 35 interiorly of the chamber 26, there may be more or less compartments, as desired, and the invention may be practiced without compartmentalization, if preferred. Associated with the drying station 25 and its cabinet or chamber 26 are suitable environmental controls, as at 40, including means for controlling temperature, humidity and air movement within the cabinet 26, and more specifically, separately controlling the temperature, humidity and air movement within compartments 33, 34 and 35, as by suitable connection means 41, 42 and 43. Thus, as will appear more fully hereinafter, the web 13*c* passes longitudinally downstream through the drying station 25, exits therefrom in relatively dry condition, as at 13*d*, for entry to a fixation station 45. The fixation station 45 may be an oven or enclosure 46 defining an internal space or heating chamber 47 having an inlet opening 48 and an outlet opening 49. Suitable web conveyor means 50, such as the festoon type, or otherwise as desired, may be located in the fixation chamber or oven 47 for passing therethrough the textile web 13*e*. The environmental controls 40 may be suitably connected, as at 44 to the fixation station 45**.

Upon completion of the dyeing reaction the web leaves the fixation station 45, as at **13*f* and passes to a mixture removal or washing station 51. At the mixture removal station 51, the mixture of dyestuff 17 remaining in the web 13*f* is removed or washed away, the washed web 13g is then coiled or wound up at a wind-up station 52, as on a coil or roll 53**.

In practice, the mixture 17 may be prepared with the inclusion of disperse dye, a solvent therefor, and gelatin, or an elastic reversible hydrocoiloid of gelatin-like characteristics. Hereinafter the terminology gel and gelatin is used in its broad sense of a substance likened to gelatin. In practice, it has been found satisfactory to include in the mixture 2% dyestuff, ½% anionic surface tension agent, 1% acetic acid, 1% gelatin, and the balance water. This mixture may be maintained in the bath of pad 15 at about 120°F to assure saturation of the fabric. After application of the mixture 17 to the textile, the squeezing rolls 18 may remove excess mixture and the web with remaining mixture is passed to the cooling station 20. The web 13*a* may be cooled sufficiently to gel the gelatin of the applied mixture, say to 50°F in this example. Rapid cooling to below the gelation temperature assures uniform liquid covering of the fabric.

While gelatin may be a preferred gel, other gels could be used, such a Algin, the rigidity of the gel being limiting as tending to damage textile fibers. In practice, it has been found that between 0.5% and 5% gelatin concentrations may be used which, of course, varies the gelation temperature. The particular gelatin of the instant example has a transition or gelation temperature of about 64°F at 3.4% concentration and 55°F at 1.5% concentration. Upon gelation, the dyebath water or solvent does not change state, but is merely trapped in the gel. Therefore, upon gelling it is not necessary to remove large quantities of heat of fusion, but mainly only sensible heat is removed. Also when subsequently drying it is not necessary to add heat of melting or dispersion.

In the drying station 25, the gelled dye mixture on the web 13*c* is constantly maintained at a wet bulb temperature or dew point just slightly below the gelation temperature, and drying or removal of water solvent occurs primarily by air movement, which conditions are suitably maintained by the controls 40. As drying progresses downstream along the path of web movement interiorly of the drying station 25, as between successive compartments 33, 34 and 35, the gel concentration increases, and, thereby, the dispersion or melting temperature of the dye mixture increases. Thus, as the web 13*c* moves downstream in the drying station 25, the controlled wet bulb temperature of the dryer atmosphere may increase without melting or liquifying of the gel, the increasing wet bulb temperature remaining slightly below the gelation temperature, so that migration is effectively prevented. Further, as the wet bulb temperature, together with the dry bulb temperature, increases downstream within the drying station 25, the drying rate increases to effectively reduce the necessary length of the drying station. Thus, the successive downstream compartments 33, 34 and 35 may be separately maintained at different, increasing wet bulb temperatures as through connections 41, 42 and 43, respectively.

At the dryer outlet 28, conditions may be the same as those for conventional drying processes. However, by the use of gelatin it is possible to effect initial drying of the outside of the gel coating to form a relatively dry, tough, rubbery outer skin, while the moisture gradient increases inwardly. That is, the surface water evaporates first so that a dispersion point difference exists between the outside and inside of the partially dried coating. This may be the condition of web region 13d, so that the dryer station may be smaller and less expensive, doing less evaporative work and consuming less fuel.

Figure 2:
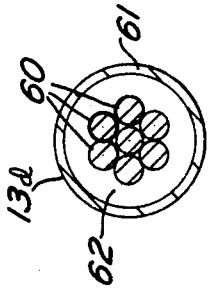
FIG. 2 is a transverse sectional view of fabric at an intermediate stage of dyeing in accordance with the teachings of the instant invention, say just prior to fixation.

In FIG. 2 is shown a cross-sectional configuration including yarn fibers, as at 60, an outer relatively dry gelatin skin 61, and an inner dispersed liquid central region 62. By sufficiently developing the outer skin 61 before center dispersion, the partially dried web can be subjected to thermal fixation in the oven 45 and contain the pressure developed, say at least 100 pounds per square inch gauge, without drying out.

Following fixation, say in a steam atmosphere at station 45 to exclude oxygen, the web exits, as at 13f and then passes to a washing station 51. Washing or dissolution of the coating and removal from the web occurs at station 51, and it appears that the washing of web samples having the skin 61, as in FIG. 2, is quicker and easier, as less time is required to dissolve the lesser amount of dried gelatin.

From the washing station 51, the web may be wound or coiled, as upon roll 53.

In addition to the foregoing, it is noted that when the subject method and apparatus are employed in conjunction with knit and textured woven fabrics, the desirable characteristics of soft-hand, flexibility and stretch are more effectively maintained, while the conveying problems caused by such characteristics are minimized or eliminated. For example, as little as 1% gelatin in the dyebath and cooling of the wet-out fabric to 50°F sufficiently stiffens most knits to prevent edge curl and tension-produced wrinkles. The stitch is sufficiently locked and the fabric stable enough to be conveyed on a roll conveyor. Also, the gelled wet fabric will not pick off on the rolls, which may be water cooled, and cleaning is minimized.

While the instant invention has been discussed in connection with polyester fabrics, it is understood that the method is capable of utilization with other fabrics. For example, in application to acrylics with basic or cationic dyes, wherein it is thought necessary to have a great deal of water present to complete the dye reaction, it is believed that the instant gelatin system and control of interior dispersed liquid can duplicate, by continuous operation, the results obtained in the past by batch pressurized systems. If preferred the operation may not be continuous but may be interrupted at a desired station or location. It is further appreciated that the instant invention is equally advantageous in single or multi-color printing to prevent the undesired transfer or migration of dye. Also the term dyeing is used herein to broadly include pattern dyeing or printing.

From the foregoing, it is seen that the present invention provides a dyeing apparatus for textiles which permits of continuous operation upon synthetic and partially synthetic fabrics to achieve results heretofore possible only by batch procedures, to effect substantial reduction in initial and continuing costs, and which otherwise fully accomplishes its intended objects.

What is claimed is:

1. Textile dyeing apparatus comprising: means for applying to textiles a mixture of dye, gelatin and solvent; cooling means for cooling the applied mixture to a temperature between the gelatin gelation temperature and the solvent freezing temperature; drying means for removing solvent and gradually raising the gelatin concentration; environmental control means for gradually raising the temperature of the applied mixture during solvent removal and maintaining the web bulb temperature below the gelation temperature; and fixation means for completing the dye reaction.

2. Textile dyeing apparatus according to claim 1, in combination with conveying means for continuously moving textiles through said applying means, cooling means, drying means, control means and fixation means.

3. Textile dyeing apparatus according to claim 1, said drying means comprising a chamber having a textile inlet and a textile outlet; and environmental control means for controlling temperature, humidity and air movement in said chamber.

4. Textile dyeing apparatus according to claim 3, said chamber including a plurality of separate compartments located sequentially along the path of textile movement between said inlet and outlet; and said control means being operatively connected to respective compartments to differently control the same.

5. Textile dyeing apparatus according to claim 1, in combination with washing means downstream of said fixation means for washing the textile after fixation to remove the remaining mixture.

* * * * *